United States Patent [19]

Sukimoto et al.

[11] Patent Number: 4,960,096

[45] Date of Patent: Oct. 2, 1990

[54] ADAPTER FOR INTAKE MANIFOLD

[75] Inventors: Minobu Sukimoto; Hitoshi Akiyoshi, both of Tochigi; Seijiro Taguchi, Ibaraki; Tadaaki Morita, Tochigi, all of Japan

[73] Assignee: Showa Aluminum Corporation, Sakai, Japan

[21] Appl. No.: 437,713

[22] Filed: Nov. 17, 1989

[30] Foreign Application Priority Data

Nov. 18, 1988 [JP] Japan ..... 63-293291
Nov. 18, 1988 [JP] Japan ..... 63-293292

[51] Int. Cl.[5] ..... F02M 25/07

[52] U.S. Cl. ..... 123/570; 123/568; 123/52 MC; 123/52 M

[58] Field of Search ..... 123/52 M, 52 MC, 52 MV, 123/568, 569, 570, 571

[56] References Cited

U.S. PATENT DOCUMENTS 3,304,711 2/1967 Eastman ..... 123/568 X
3,542,005 11/1970 Brimer ..... 123/568
4,615,324 10/1986 Chowshi et al. ..... 123/52 MV
4,643,137 2/1987 Choushi et al. ..... 123/52 MV
4,696,279 9/1987 Lindberg ..... 123/570
4,741,295 5/1988 Hosoya et al. ..... 123/52 MV

FOREIGN PATENT DOCUMENTS 0051939 4/1980 Japan ..... 123/570

*Primary Examiner*—Willis R. Wolfe
*Attorney, Agent, or Firm*—Armstrong, Nikaido, Marmelstein, Kubovcik & Murray

[57] ABSTRACT

An intake manifold adapter comprising an adaper body made of aluminum and having a gas channel adapted to communicate at its one end with the outlet of a throttle body for holding an air cleaner in communication with an intake manifold and at the other end thereof with the inlet of the manifold, and an exhaust gas inlet pipe having an aluminum portion at its one end and a stainless steel portion secured thereto and providing the other end of the pipe, the inlet pipe being fixed to the adapter body by the aluminum portion being metallurgically joined to the body, the stainless steel portion providing a joint for a pipe for returning the exhaust gas from an engine to the manifold.

8 Claims, 4 Drawing Sheets

ADAPTER FOR INTAKE MANIFOLD

BACKGROUND OF THE INVENTION

The present invention relates to an adapter which is to be attached to the inlet end of an intake manifold and connected to means for holding an air cleaner in communication with the manifold, for example, for use in trucks, the adapter being adapted for use in connecting to the intake manifold a pipe for returning the exhaust gas from the engine to the intake manifold.

The term "aluminum" as used herein and in the appended claims includes pure aluminum, commercial pure aluminum containing traces of impurities and aluminum alloys. The term "wrought aluminum" as used herein refers to aluminum articles formed by plastic working. Further the term "metallurgical joining" as used herein and in the appended claims includes welding, brazing and soldering.

To ensure complete combustion of exhaust gas and an increased efficiency, for example, in trucks, the exhaust gas is partly returned to the intake manifold and burned in the engine cylinder. Since the exhaust gas has a high temperature of about 350° C., a pipe of stainless steel or carbon steel is used for returning the exhaust gas. Conventionally, stainless steel or carbon steel adapter is attached to the inlet end of the intake manifold and has connected thereto a throttle body constituting means for holding an air cleaner in communication with the manifold. The exhaust gas return pipe is brazed to the adapter.

However, the conventional adapter has the problem of being heavy and costly.

Accordingly, aluminum adapters are considered useful, whereas the exhaust gas return pipe of stainless steel or carbon steel is difficult to braze to the adapter. Moreover, a layer of intermetallic compound is formed in the brazed joint, which therefore becomes brittle and is liable to break owing to vibration.

SUMMARY OF THE INVENTION

The main object of the present invention is to provide an intake manifold adapter which is free of the above problem.

The present invention provides an intake manifold adapter attachable to the inlet end of an intake manifold and connectable to means for holding an air cleaner in communication with the intake manifold, the adapter being adapted for use in connecting to the manifold a pipe for returning the exhaust gas from an engine to the manifold. The adapter comprises an adapter body made of aluminum and having a gas channel adapted to communicate at its one end with the outlet of the communication means and at the other end thereof with the inlet of the intake manifold, and an exhaust gas inelt pipe having an aluminum portion at its one end and a stainless steel portion secured to the aluminum portion and providing the other end of the inlet pipe, the inlet pipe being fixed to the adapter body by the aluminum portion being metallurgically joined to the adapter body, the stainless steel portion providing a joint for the pipe for returning the exhaust gas from the engine.

The adapter of the present invention the body of which is made of aluminum is less heavy and less costly than the conventional adapter which is made of stainless steel. The adapter body, even when made of aluminum, can be protected since the hot exhaust gas returned into the adapter body is rapidly cooled by being mixed with a large quantity of air taken in and having a low temperature. The exhaust gas inlet pipe has an aluminum portion at its one end and a stainless steel portion secured thereto and providing the other pipe end and is fixed to the adapter body by the aluminum portion being metallurgically joined to the body. Accordingly, the inlet pipe can be fixed firmly to the adapter body. Further because the stainless steel portion of the inlet pipe provides the joint to the pipe for returning the exhaust gas from the engine, the return pipe can be metallurgically joined to the inlet pipe with ease and high strength.

The present invention will be described in greater detail with reference to the accompanying drawings.

DESCRIPTION OF THE PREFERRED EMBODIMENTS

Figure 1:
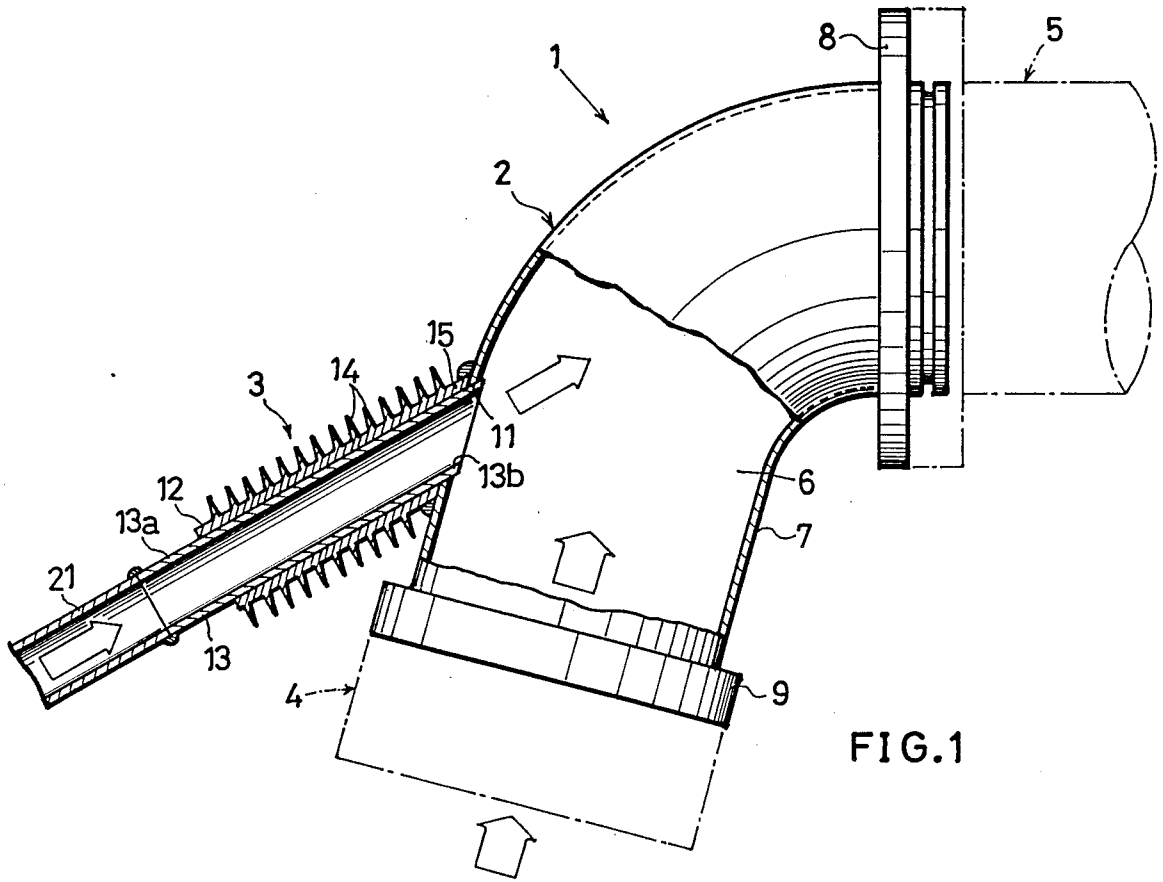
FIG. 1 is a front view partly broken away and showing an embodiment of intake manifold adapter.

Throughout the drawings, like parts are designated by like reference numerals and will not be described repeatedly.

With reference to FIG. 1 showing an intake manifold adapter embodying the invention, the adapter 1 comprises an aluminum adapter body 2 and an exhaust gas inlet pipe 3 secured to the body 2.

The adapter body 2 comprises a bent pipe 7 made of an aluminum extrudate, and flanges 8 and 9 made of wrought aluminum and fixedly joined to opposite ends of the pipe 7. The bent pipe 7 has a gas channel 6 with one end in communication with an air outlet of a throttle body 4 which has a throttle valve (not shown) therein and which is a member positioned closest to an intake manifold 5 and included in means for holding an air cleaner in communication with the manifold 5. The other end of the channel 6 is in communication with the air inlet of the manifold 5. The flange 8 is used for attaching the adapter 1 to the plenum chamber (not shown) of the intake manifold 5. The other flange 9 serves to attach the adapter to the throttle body 4 having the unillustrated throttle valve therein. An exhaust gas inlet opening 11 is formed in the peripheral wall of the pipe 7.

The exhaust gas inlet pipe 3 is in the form of a double pipe comprising an aluminum outer pipe 12 and a stainless steel inner pipe 13 positioned inside the pipe 12 in intimate contact therewith. The outer pipe 12 is integrally formed on its peripheral surface with fins 14 formed by rolling for cooling the exhaust gas. Cooling fins of other type may be provided in place of the rolled fins 14. The inner pipe 13 has opposite ends projecting outward beyond the respective ends of the outer pipe 12. One of the projecting ends provides a joint **13*a* for an exhaust gas return pipe 21. The other projecting end serves as the portion 13*b*inserts in the adapter body 2. The end of the outher pipe 12 adjacent to the inserted portion 13*b* serves as an aluminum portion 15 metallurgically joined to the adapter body 2**. The inserted portion 13*b* is tightly fitted in the gas inlet opening 11 formed in the pipe 7 of the adapter body 2, with the aluminum outer pipe 12 in bearing contact with the outer surface of the pipe 7. The aluminum portion 15 of the outer pipe 12 at the end thereof adjacent the adapter body 2 is brazed to the pipe 7 of the adapter body 2, whereby the exhaust gas inlet pipe 3 is fixed to the adapter body 2.

Figure 2:
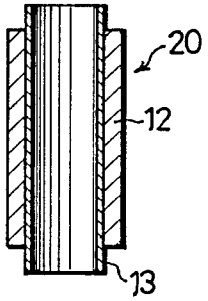
FIGS. 2 (A), (B), (C) and (D) are views in vertical section showing stepwise a process for preparing the exhaust gas inlet pipe of the adapter of FIG. 1.
Figure 2:
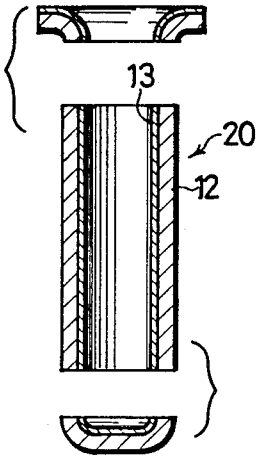
Figure 2:
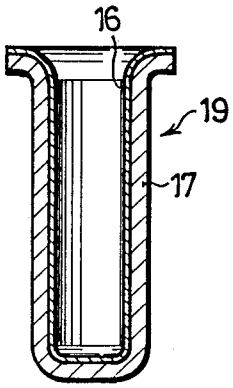
Figure 2:
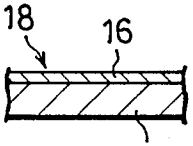

The gas inelt pipe 3 is prepared, for example, by the process shown in FIG. 2.

First, an aluminum sheet 17 is clad with a stainless steel sheet 16 by explosive pressure welding to obtain a clad plate 18 (see FIG. 2 (A)). The clad plate 18 is then drawn with the stainless steel sheet positioned inside to form a hollow cylindrical tube 19 open at its one end, closed at the other end thereof and having a flange at the open end (see FIG. 2 (B)). The opposite ends of the tube 19 are cut off to obtain a double pipe 20 which is open at its opposite ends and which comprises the aluminum outer pipe 12 and the stainless steel inner pipe 13 (see FIG. 2 (C)). Opposite ends of the aluminum outer pipe 12 are thereafter cut away each over a predetermined length to cause the stainless steel inner pipe 13 to project outward at opposite ends thereof beyond the outer pipe 12 (see FIG. 2 (D)). The rolled fins 14 are formed on the outer surface of the aluminum outer pipe 12. Finally one end of the double pipe 20 is obliquely cut to make the cut projecting end serve as the portion 13*b* to be inserted into the adapter body. The other projecting end is made to serve as the joint 13*a* for the gas return pipe 21. In this way, the gas inlet pipe 3 is prepared.

The pipe 3 can be produced not only by the process shown in FIG. 2 but also by the following processes. A stainless steel pipe is clad with an aluminum pipe by explosive pressuring welding to form a double pipe which is open at its opposite ends and comprises the aluminum outer pipe and the stainless steel inner pipe. The same steps as in the process of FIG. 2 thereafter follow. The gas inlet pipe can be produced also by inserting a stainless steel pipe into an aluminum pipe, diametrically enlarging the inner pipe to obtain a double pipe, and thereafter treating the double pipe in the same manner as in the process of FIG. 2. To completely prevent the returned exhaust gas from leaking in this case, it is desired that the outer end of the outer pipe opposite to the end thereof joined to the adapter body be brazed or welded to the inner pipe.

The adapter 1 is attached to the inlet end of the plenum chamber of the intake manifold 5 by the flange 8, with the gas chamber 6 in communication with the plenum chamber. The throttle body 4 having the throttle valve housed therein is attached to the other flange 9 so as to communicate with the gas channel 6.

The exhaust gas having a high temperature and returned into the adapter body 2 is rapidly cooled by being mixed with the air of a low temperature flowing through the adapter body 2 in a large quantity.

Figure 3:
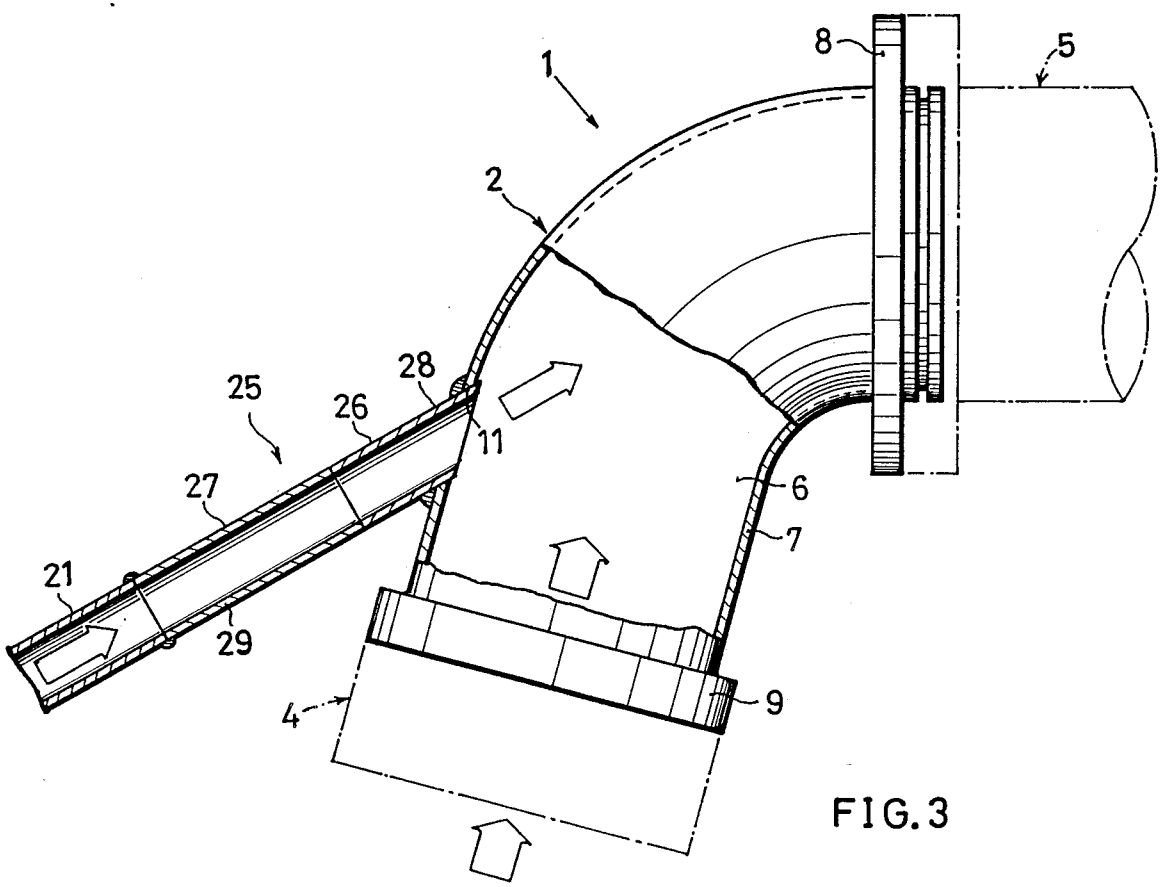
FIG. 3 is a front view partly broken away and showing another embodiment of intake manifold adapter.

With reference to FIG. 3 showing another embodiment of the invention, an exhaust gas inlet pipe 25 is prepared from an aluminum pipe 26 and a stainless steel pipe 27 joined thereto end to end by friction welding. The free end of the pipe 26 is an aluminum portion 28 metallurgically joined to the adapter body 2. The inlet pipe 25 is fixed to the adapter body 2 by inserting the free end of the aluminum pipe 26 into an opening 11 formed in the pipe 7 of the adapter body 2 and brazing the end to the pipe 7. The free end of the stainless steel pipe 27 of the gas inlet pipe 25 serves as a joint 29, to which the exhaust gas return pipe 21 of stainless steel is welded.

Figure 4A:
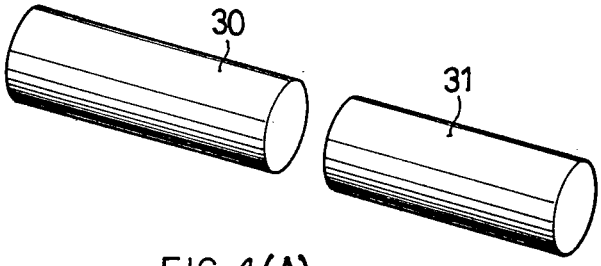
FIGS. 4 (A), (B) and (C) are perspective views showing stepwise a process for preparing the exhaust gas inlet pipe of the adapter of FIG. 3.
Figure 4B:
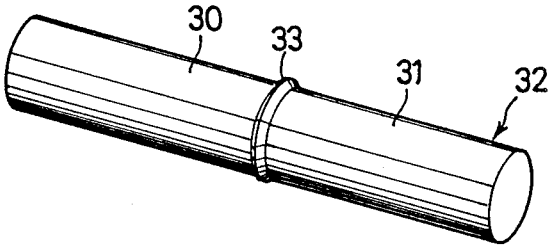
Figure 4C:
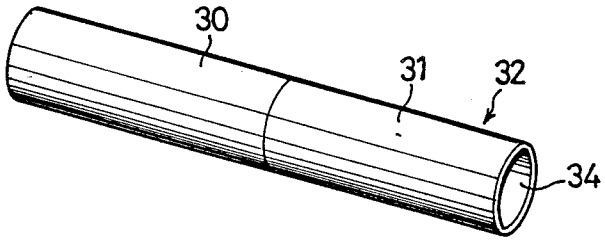

The exhaust gas inlet pipe 25 is produced, for example, by the process shown in FIG. 4.

A solid aluminum rod 30 and a solid stainless steel rod 31 are prepared first (see FIG. 4 (A)). The two rods 30, 31 are then joined together end to end by friction welding to prepare a composite material 32 (see FIG. 4 (B)). Subsequently, the burr 33 formed at the joint of the two rods 30, 31 is removed from the material 32, and the material 32 is bored to form a bore 34 extending axially therethrough (see FIG. 4 (C)). The aluminum end of the composite material 32 is thereafter cut off obliquely. In this way, the inlet pipe 25 is produced.

The process for producing the exhaust gas inlet pipe is not limited to the processes described above.

What is claimed is:

1. An intake manifold adapter attachable to the inlet end of an intake manifold and connectable to means for holding an air cleaner in communication with the intake manifold, the adapter being adapted for use in connecting to the intake manifold a pipe for returning the exhaust gas from an engine to the intake manifold, the adapter comprising:

an adapter body made of aluminum and having a gas channel adapted to communicate at its one end with the outlet of the communication means and at the other end thereof with the inlet of the intake manifold, and an exhaust gas inlet pipe having an aluminum portion at its one end and a stainless steel portion secured to the aluminum portion and providing the other end of the inlet pipe, the inlet pipe being fixed to the adapter body by the aluminum portion being metallurgically joined to the adapter body, the stainless steel portion providing a joint for the pipe for returning the exhaust gas from the engine.

2. An adapter as defined in claim 1 wherein the opening of the exhaust gas inlet pipe at the end thereof fixed to the adapter body is directed toward the manifold-side end opening of the gas channel.

3. An adapter as defined in claim 1 wherein the exhaust gas inlet pipe is in the form of a double pipe comprising an aluminum outer pipe and a stainless steel inner pipe positioned inside the outer pipe in intimate contact therewith, and the inner pipe has one end projecting outward beyond one end of the outer pipe and providing the joint for the exhaust gas returning pipe, the other end of the outer tube being the aluminum portion metallurgically joined to the adapter body.

4. An adapter as defined in claim 3 wherein the outer pipe is provided with radiation fins on its outer peripheral surface.

5. An adapter as defined in claim 3 wherein the exhaust gas inlet pipe is prepared from a tube open at its one end and closed at the other end thereof, the tube being formed by cladding an aluminum sheet with a stainless steel sheet by explosive pressure welding and drawing the resulting plate with the stainless steel sheet positioned inside, the inlet pipe being prepared by cutting off opposite ends of the tube to obtain the double pipe comprising the aluminum outer pipe and the stainless steel inner pipe, and cutting away one end of the outer pipe of the double pipe over a predetermined length to cause the inner pipe to project outward beyond the outer pipe.

6. An adapter as defined in claim 1 wherein the exhaust gas inlet pipe is prepared from an aluminum pipe and a stainless steel pipe fixedly joined thereto end to end, the free end of the aluminum pipe being the aluminum portion metallurgically joined to the adapter body, the free end of the stainless steel pipe providing the joint for the exhaust gas returning pipe.

7. An adapter as defined in claim 6 wherein the aluminum pipe and the stainless steel pipe of the inlet pipe are joined together end to end by friction welding.

8. An adapter as defined in claim 6 wherein the exhaust gas inlet pipe is prepared from a composite material comprising a solid aluminum rod and a solid stainless steel rod joined thereto end to end by friction welding, by forming a bore in the composite material axially therethrough.

* * * * *